US005078058A

United States Patent [19]

Schwede et al.

[11] Patent Number: 5,078,058

[45] Date of Patent: Jan. 7, 1992

[54] TENSIONING DEVICE FOR A PACKAGING TAPE

[76] Inventors: Horst Schwede, Rosenstrasse 22, D-8589 Bindlach; Roland Schwede, Furtwänglerstrasse 10; Helmut Schmetzer, Almstrasse 5, both of D-8580 Bayreuth, all of Fed. Rep. of Germany

[21] Appl. No.: 587,972

[22] Filed: Sep. 25, 1990

[30] Foreign Application Priority Data

Oct. 10, 1989 [DE] Fed. Rep. of Germany ..... 3933756

[51] Int. Cl.[5] ..... B65B 13/22

[52] U.S. Cl. ..... 100/32; 53/589; 100/26; 226/168; 474/10

[58] Field of Search ..... 100/8, 26, 29, 32; 226/168, 173, 190; 53/589; 474/10

[56] References Cited

U.S. PATENT DOCUMENTS

| | | | |
|---|---|---|---|
| 812,677 | 2/1906 | Paulson | 474/10 |
| 1,058,156 | 4/1913 | Crossley | 474/10 X |
| 1,565,865 | 12/1925 | Ragona | 100/32 |
| 1,663,154 | 3/1928 | Bissett | 474/10 |
| 3,146,694 | 9/1964 | Staron et al. | 100/32 X |
| 3,249,335 | 5/1966 | Eisenhauer | 474/10 X |
| 3,752,058 | 8/1973 | Lems | 100/32 |

FOREIGN PATENT DOCUMENTS

| | | | |
|---|---|---|---|
| 658572 | 6/1929 | France | 474/10 |
| 267093 | 4/1989 | German Democratic Rep. | 474/10 |

*Primary Examiner*—Philip R. Coe
*Assistant Examiner*—Stephen F. Gerrity
*Attorney, Agent, or Firm*—Laff, Whitesel, Conte & Saret

[57] ABSTRACT

A tensioning device for a packaging tape, which is slung around a stack of goods in a packaging station and of which the free end is held there, has a driving plate drivable by a motor around an axis of rotation with a bearing surface for the tape. Clamping elements each having a clamping surface are associated with the driving plate. At least one guiding element is provided for the clamping elements, by means of which, in a closing area smaller than the surrounding angle of the tape around the bearing surface, the clamping elements can be brought into a position, in which the tape is non-positively held between the clamping surfaces and the bearing surface.

16 Claims, 3 Drawing Sheets

48
44
47
21
24
27
23
22
16
42
41
39
40
e
33
37
28
a
20
b
13
45
46
25
d
29
34
36
35
c
30
18
32
19
17
38
51
26
4
15
31
49
r

TENSIONING DEVICE FOR A PACKAGING TAPE

FIELD OF THE INVENTION

The invention relates to a tensioning device for a packaging tape, which is slung around a stack of goods in a packaging station and of which the free end is held there, with a device to clampingly hold and to transport the tape in a tensioning direction being provided.

BACKGROUND OF THE INVENTION

Packaging stations are known, in which stacks of goods, preferably stacks of journals, are hooped with a packaging tape, i.e. the packaging tape is slung once around the stack of goods. The ends of the packaging tape are connected with each other. Such packaging stations are also designated as hooping stations, since formerly metal sheet tapes were preferably used as packaging tape. Since the packaging tape is to hold the stack of goods tightly together, the tape must be tensioned before the two ends are connected, and this tensioning must be the more distinct, the softer, i.e. the more compressible, the goods are that form the stack. Especially in the case of journals having advertising material inserted in their middle only, the stack of goods is compressed strongly and in particular non-uniformly compressed upon tensioning.

Tensioning devices are known to have the tape gripped by means of a clamping device and then tensioned by means of a lever and by a path length limited by the maximum lever travelling path. Further tensioning devices are known, with which the tape is pressed against a tensioning disk by means of one or several rolls. No sufficiently strong tensioning forces can thus be achieved.

SUMMARY OF THE INVENTION

It is accordingly the object of the invention to embody a tensioning device of the generic type, by means of which the tensioning of the packaging tape by any desired and unlimited tensioning path length is possible while generating tensioning forces of any desired intensity.

This object is attained in accordance with the invention by a driving plate drivable by a motor around an axis of rotation with a bearing surface for the tape being provided, by clamping elements with clamping surface being associated with the driving plate and by at least one guiding element being provided for the clamping elements, by means of which, in a closing area smaller than the surrounding angle of the tape around the bearing surface, the clamping elements can be brought into a position, in which the tape is non-positively held between its clamping surfaces and the bearing surface. The measures according to the invention make it possible that the tape is clamped and taken along between a bearing surface of a driving plate and clamping elements associated with it, these clamping elements being released or brought into a clamping position, respectively, with the revolution of the driving plate and of the tape held by it. Further features, advantages and details of the invention will become apparent from the sub-claims and the ensuing description of an embodiment taken in conjunction with the drawing.

DESCRIPTION OF THE PREFERRED EMBODIMENT

Figure 1:
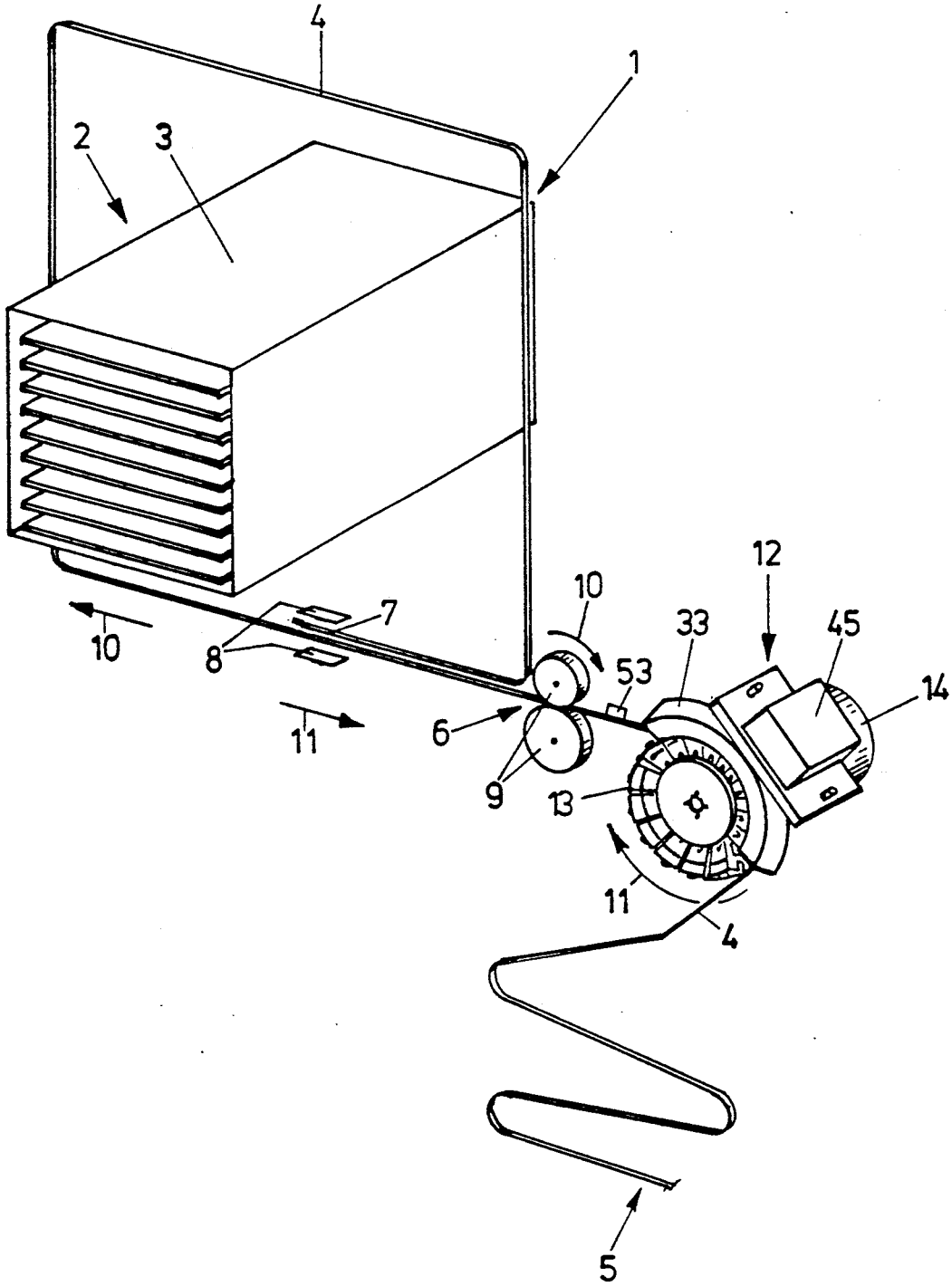
FIG. 1 shows a packaging station with a tensioning device according to the invention in a perspective diagrammatic representation.

As can be seen from FIG. 1, a stack of goods 2, for example a stack of journals that may be enveloped in packing material 3, is surrounded with a packaging tape 4 in a packaging station 1. The packaging tape 4 is drawn from a store 5 and, by means of a so-called entering device 6, is entered into the packaging station 1 while loosely surrounding the stack of goods 2. In the packaging station 1 the free end 7 of the tape 4 is gripped and held by a clamp 8. The entering device 6 consists of a pair of rolls 9 drivable at high speed and a drive motor not shown in the drawing. By a reversion of the direction of rotation of the pair of rolls 9 the tape 4, of which the free end 7 is held by the clamp 8 in the packaging station 1, is drawn back against the entering direction 10 in a tensioning direction 11 until it bears against the stack of goods 2. Such a packaging station 1 with an entering device 6 for a packaging tape 4 with a clamp 8 and deflection devices for the tape 4, which are not shown in the drawing and by means of which the tape 4 is guided around the stack of goods 2, is commonly known and widely spread in practice.

In order that the tape 4 surrounding the stack of goods 2 be tightly slung around the latter, a motor-driven tensioning device 12 is arranged between the entering device 6 and the store 5. This device 12 has a driving plate 13 drivable by a stationary electric motor 14 in the tensioning direction 11. The plate 13 has a cylindrical circumferential surface serving as a bearing surface for the tape 4. On its side facing away from the motor the plate 13 is provided with a cylindrical projection 17, which extends concentrically to the axis of rotation 16 and to the front side of which a circular-disk-shaped covering plate 18 is secured by means of screws 19. A rotating annular groove 20 open to the outside is formed between the plate 13, the covering plate 18 and the projection 17.

Figure 2:
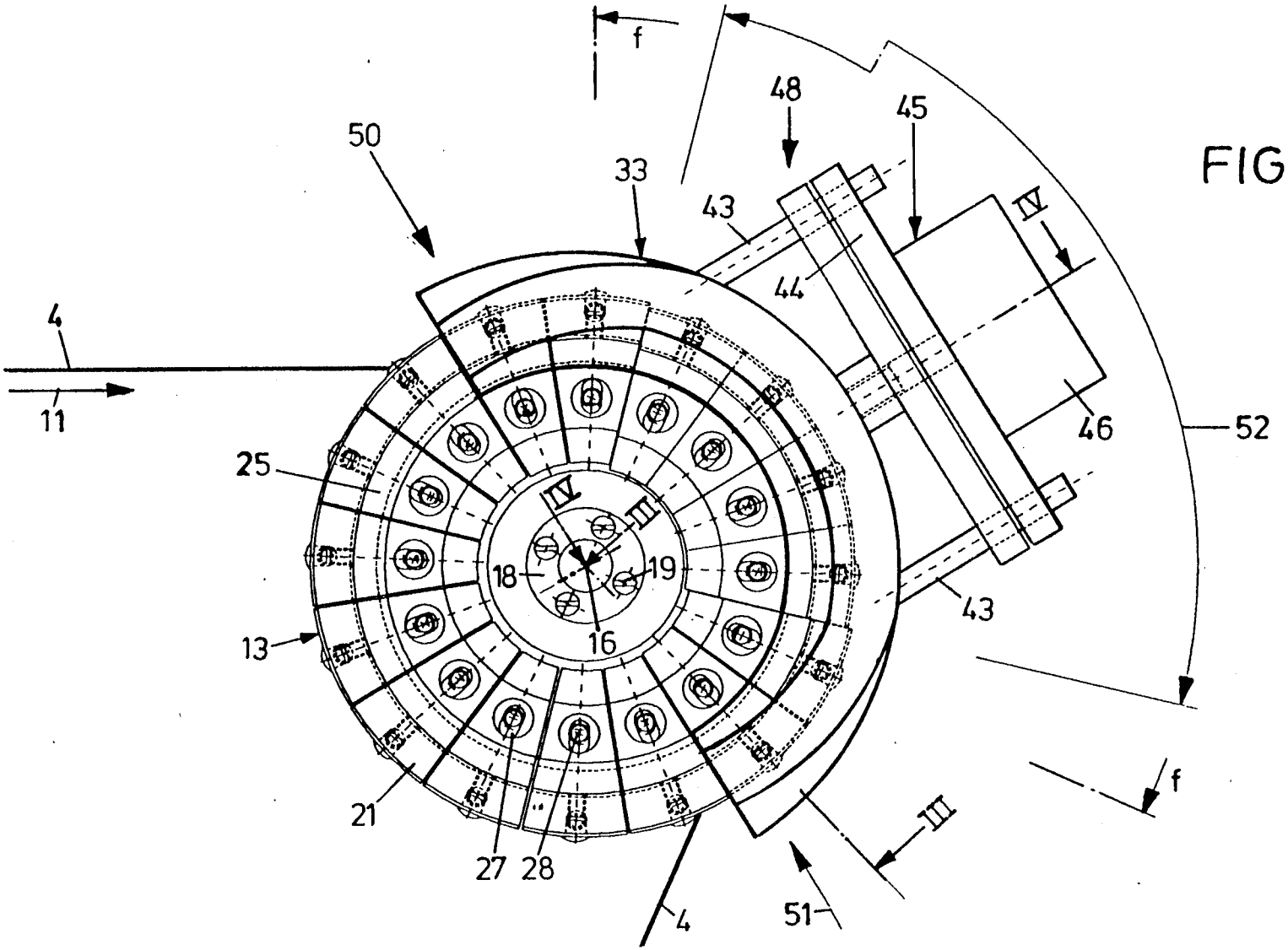
FIG. 2 is a top view of the tensioning device.

In the top view according to FIG. 2 clamping elements 21 in the form of a sector of an annular circle are arranged on the plate 13 and over its total circumference. At their end located radially inwards these clamping elements 21 have a partially cylindrical pivot journal 22 extending by more than 180°, of which the diameter a approximately corresponds to the width b of the annular groove 20 in the direction of the axis of rotation 16, so that this pivot journal 22 and thus the respective clamping element is held tight in the direction of the axis of rotation 16, but radially slidable relative to the latter and pivotable around the axis 23 of the pivot journal 22 in the annular groove 20, as will be described below in greater detail on the basis of FIGS. 3 to 5. The pivot journal 22 is followed by a lever 24, which on the side facing the plate 13 opens tangentially out of the pivot journal, so that it tightly bears against the plate in the position shown in FIGS. 4 and 5. The thickness c of the lever 24 in the direction of the rotational axis 16 is less than the width b of the annular groove 20, so that the pivot journal 22 rises above the lever 24 on the side facing towards the covering plate 18.

A clamping jaw 25 is formed radially outside on the lever 24 and protrudes in the direction of the plate 13 and has a clamping surface 26. In the position shown in FIGS. 4 and 5, when the clamping element 21 tightly bears against the plate 13 with its lever 24, the clamping surface 26 is arranged radially outside and above the bearing surface 15 of the plate 13 and extends parallel to it. It is therefore also in the form of a part of an annular cylinder, with its curvature being almost identical with the curvature of the bearing surface 15, i.e. its radius of curvature is almost identical with the radius r of the bearing surface 15. A longitudinal hole 27 is provided in the lever 24, which extends radially to the axis of rotation 16 and through which passes a driving pin 28 screwed into a threaded bore 29 in the plate 13. The clamping element 21 can be slid radially to the axis of rotation 16 and pivoted around the axis 23 of the pivot journal 22 on this driving pin 28, namely between the position shown in FIGS. 4 and 5 with the lever 24 bearing against the plate 13 and the position shown in FIG. 3 with the lever 24 bearing against an inclined stop surface 30 on the covering plate 18. The clamping element 21 is pressed into this position by a pretensioned helical compression spring 31 arranged on the driving pin 28 between the plate 13 and the lever 24. Further, a pretensioned compression spring 32 is arranged at the bottom of the annular groove 20, which compression spring 32 bears against the projection 17, on the one hand, and against the pivot journal 22, on the other hand, and thus tends to press the clamping element 21 into the radially shifted position shown in FIGS. 3 and 4. This compression spring 32 may be a rubber spring, a metal spring or the like. Each clamping element 21 is held and taken along by the associated driving pin 28 in the direction of rotation of the plate 13. Adjacent clamping elements 21 lie closely together with their sides.

Figures 3, 4, 5:
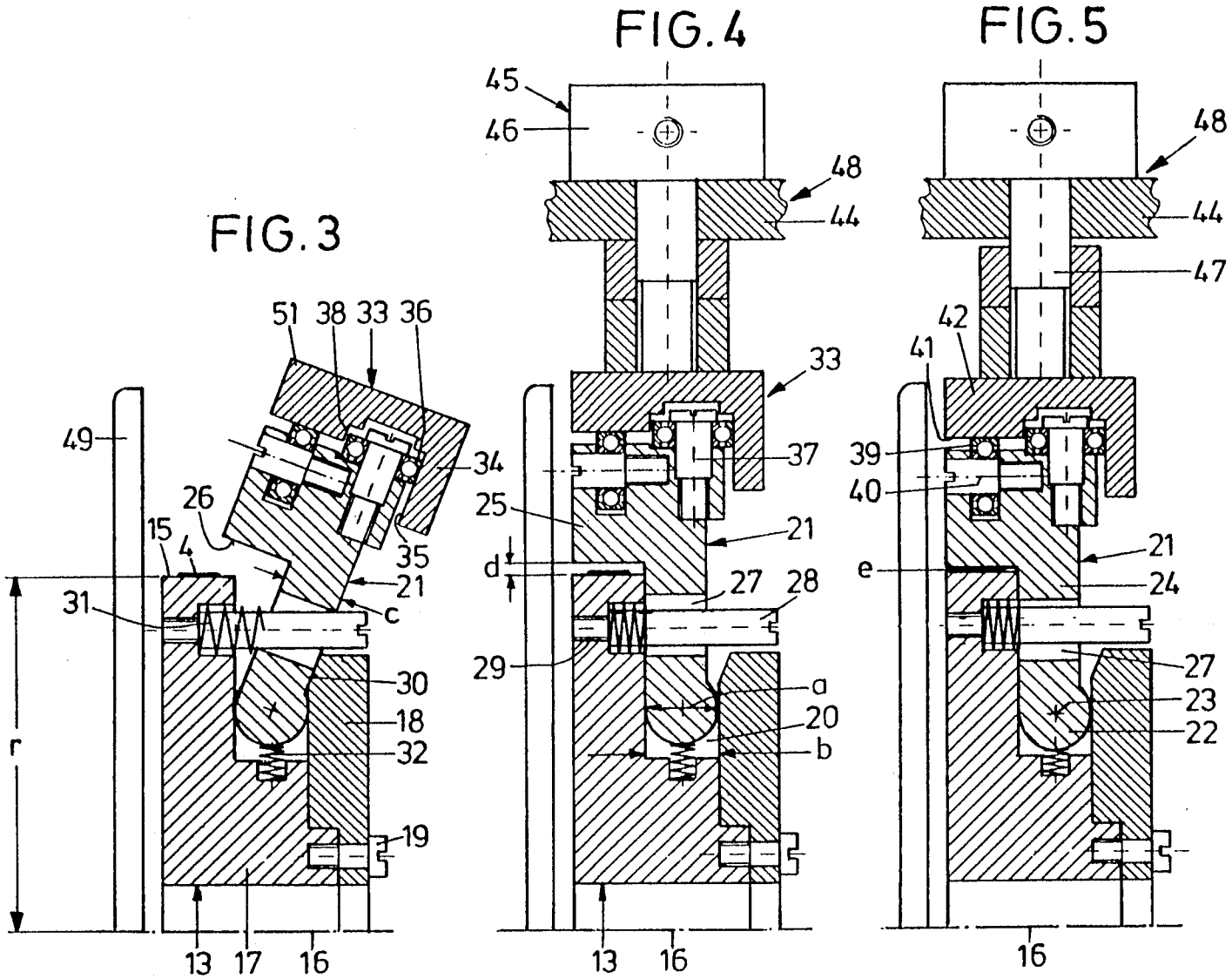
FIG. 3 is a half section through the tensioning device along the section line III—III of FIG. 2.
FIG. 4 is a half section through the tensioning device along the section line IV—IV of FIG. 2 with the press-on device opened.
FIG. 5 is a half section through the device along the section line IV—IV of FIG. 2 with the press-on device closed.

A guiding element 33 effective in two dimensions is provided to guide the clamping element 21 between the three positions shown in FIGS. 3 to 5. This guiding element 33 has a path element 34 extending over approximately 180° and having a guiding surface 35 bent in the direction of the axis of rotation 16. The clamping element 21 is guided on this guiding surface 35 by a guiding wheel 36, which may be a roller bearing, in particular a ball bearing, of which the axis 37 runs exactly radially to the axis of rotation 16 in the position shown in FIGS. 4 and 5. A counter-guiding surface 38 is provided on the side of the guiding wheel 36 diametrically opposite the guiding surface 25 and ensures that the guiding wheel 36 always bears against the guiding surface even if there is no helical compression spring 31.

A further guiding wheel 39 is positioned above the clamping surface 26 rotatably around an axis 40 on the clamping jaw 25, which axis 40 is perpendicular to the axis 37 and runs parallel to the axis of rotation 16 in the position shown in FIGS. 4 and 5. This guiding wheel 39, too, may be a roller bearing and in particular a ball bearing. This guiding wheel 39 bears against a guiding surface 41 of a path element 42 forming one piece with the path element 34.

By means of tail rods 43 the whole guiding element 33 is supported radially movable relative to the axis of rotation 16 and otherwise stationarily in a guide bearing 44. It is slidable in the direction of the tail rods 43, i.e. radially to the axis of rotation 16, by means of a linear drive 45 in the form of a pneumatically actuatable piston-cylinder drive. The cylinder 46 tightly connected with the plate-like guide bearing 44 is tightly connected with a machine frame in a manner not shown in detail, while the piston rod 47 engages with the guide element 33. The path element 42 can be pressed in the direction towards the bearing surface 15 of the driving plate 13 by means of this press-on device 48, whereby the clamping element 21 is shifted from the position shown in FIG. 4 into the position shown in FIG. 5, whereby in turn the tape 4 is clamped between the bearing surface 15 of the driving plate 13 and the clamping surface 26 of the clamping jaw 25. On the side facing towards the motor 14 a stop plate 49 only shown in FIGS. 3 to 5 is provided, by means of which the tape 4 is prevented to roll off the bearing surface 15 in the direction towards the motor 14. The distance of this plate 49 from the bearing surface 15 is very small.

The device operates as follows:

When the tape 4 is entered in the position shown in FIG. 1, the motor 14 is at rest. Further, the piston rod 47 is in its position retracted in the cylinder 46. In the whole area outside the guiding element 33 the clamping elements 21 are in a position corresponding to FIG. 3, which, however, does not show any guiding element 33. In the inlet area 50 and in the outlet area 51 of the guiding element 33 the guiding wheels 36 and 39 are already in contact with the guiding surfaces 35 and 41, respectively; the clamping element 21 is however still in a position shifted radially outwards and pivoted out of its clamping position, as shown in FIG. 3. In a closing area 52 of the guiding element 33 the guiding surfaces 35 and 41, respectively, extend such that the respective clamping element 21 is pivoted in the position shown in FIG. 4, the clamping surface 26 of the clamping jaw 25 still being at a distance d from the bearing surface 15 of the plate 13, which distance d is greater than the thickness e of the tape 4. The distance d usually amounts to between 1 and 2 mm. The closing area 52 of the guiding element 33 and usually also the circumferential extension of the guiding element 33 as a whole are smaller than the surrounding angle f of the tape 4 on the plate 13.

When a tape 4 has been entered into the station 1 and its free end 7 is held in the clamp 8, i.e. when the stack of goods is hooped by the tape 4, then the pair of rolls 9 is driven in tensioning direction, whereby—as described above—the tape 4 comes to bear against the stack of goods 2. At the same time the motor 14 is put on so that it drives the driving plate 13 in the tensioning direction 11. The cylinder 46 is actuated with compressed air so that the guiding element 33 is moved towards the bearing surface 15 in a radial direction relative to the axis of rotation 16 in the manner already described. Since the driving plate 13 rotates, all clamping elements 21 in the total closing area 52 of the guiding element 33, on the one hand, are upon this pivoted over the bearing surface 15 and pressed on it at the same time, whereby the tape 4 is taken along in the tensioning direction 11. A tensioning of the tape 4 around the stack of goods 2 thus results at a very high speed, whereby the tape 4 comes into tight contact with the stack of goods 2. In particular, when the stack of goods consists of highly compressible material, such as journals with advertising material inserted, a strong tying together or pressing together or compressing, respectively, of the stack of goods 2 is effected.

The linear drive 45 is released, i.e. the guiding element 33 is again driven radially away from the plate 13, when the tensioning of the tape 4 is finished. This can happen automatically by means of a tape-tension measuring device 53 measuring the tension of the tape 4 or the force acting in the tensioning direction 11. When a pre-determined tape-tension-value is achieved the motor is stopped. With a short delay the cylinder 46 is then released so that the guiding element 33 again takes its position shifted radially outwards. This shifting of the guiding element 33 only takes place after the tape 4 is closed around the stack of goods 2 and the station 1 is free for a new stack of goods to be surrounded by a tape 4.

A timer member can be provided instead of the tape-tension measuring device 53, with the time being set during which the electric motor 14 is driven. Since its rotational speed and the radius r of the bearing surface 15 are known, the length can thus be determined by which the tape 4 is tensioned. The timer member is therefore to be adjusted on the basis of corresponding empirical values.

Finally, a safety coupling with adjustable torque can be provided between the plate 13 and the motor 14 stopping the driving of the plate 13 when a certain torque of steady relation to the tension force of the tape 4 is achieved.

What is claimed is:

1. A tensioning device for a packaging tape, which is slung around a stack of goods in a packaging station with a clamp for holding a free end of the tape, comprising:

a driving plate (13) which has axis of rotation (16) and a bearing surface (15) for the tape (4);

a motor (14) which is in driving connection with said driving plate (13) and which is provided for driving said driving plate (13) around said axis of rotation (16) in a tensioning direction (11) of said tape (4);

clamping elements (21) each of which has a clamping surface (26) and which are associated with the driving plate (13);

a supporting area in which the tape (4) is supported by the bearing surface (15) and which extends over a surrounding angle (f) of the tape (4) around the bearing surface (15);

a closing area (52) which is smaller than the surrounding angle (f) of the tape (4) and which is arranged within said supporting area; and at least one guiding element (33) for the clamping elements (21), by means of which, in said closing area (52), the clamping elements (21) are brought into a position, in which the tape (4) is non-positively held between the clamping surfaces (26) of the clamping elements (21) and the bearing surface (15); and the clamping elements (21) are pressed by means of the guiding element (33) radially to the axis of rotation (16) towards the bearing surface (15) of the driving plate (13).

2. A device according to claim 1, wherein the clamping elements (21) are pivotable by means of the said guiding element (33) substantially parallel to the direction of the axis of rotation (16) away from and towards the bearing surface (15).

3. A device according to claim 2, wherein each clamping element (21) is supported by way of a spring (31) against the driving plate (13) in a direction, which is substantially parallel to the direction of the axis of rotation (16).

4. A device according to claim 1, wherein the guiding element (33) has a second guiding surface (41) to guide the clamping element (21) at a predetermined distance (d) of its clamping surface (26) from the bearing surface (15).

5. A device according to claim 4, wherein a press-on device (48) is provided to press at least the second guiding surface (41) against the bearing surface (15) radially to the axis of rotation (16).

6. A device according to claim 5, wherein at least one second guiding wheel (39) is provided to guide each clamping element (21) on the second guiding surface (41) of the guiding element (21).

7. A device according to claim 4, wherein the second guiding surface (41) has at least one inlet area (50) for the clamping elements (21).

8. A device according to claim 4, wherein the second guiding surface (41) has an outlet area (51).

9. A device according to claim 4, wherein at least one first guiding wheel (36) is provided to guide each clamping element (21) on the guiding surface (35) of the guiding element (33).

10. A device according to claim 1, wherein each clamping element (21) is supported by way of a spring (32) against the driving plate (13) in a direction radial to the axis of rotation (16).

11. A device according to claim 1, wherein each clamping element (21) is connected with the driving plate (13) by means of a driving pin (28).

12. A device according to claim 11, wherein each driving pin (28) is guided in a longitudinal hole (27) extending radially to the axis of rotation (16).

13. A tensioning device for a packaging tape, which is slung around a stack of goods in a packaging station with a clamp for holding a free end of the tape, comprising:

a driving plate (13) which has an axis of rotation (16) and a bearing surface (15) for the tape (4);

a motor (14) which is in driving connection with said driving plate (13) and which is provided for driving said driving plate (13) around said axis of rotation (16) in a tensioning direction (11) of said tape (4);

clamping elements (21) each of which has a clamping surface (26) and which are associated with the driving plate (13);

a supporting area in which the tape (4) is supported by the bearing surface (15) and which extends over a surrounding angle (f) of the tape (4) around the bearing surface (15);

a closing area (52) which is smaller than the surrounding angle (f) of the tape (4) and which is arranged within said supporting area; and at least one guiding element (33) for the clamping elements (21), by means of which, in said closing area (52), the clamping elements (21) are brought into a position, in which the tape (4) is non-positively held between the clamping surfaces (26) of the clamping elements (21) and the bearing surface (15);

the clamping elements (21) are pivotable by means of the said guiding element (33) substantially parallel to the direction of the axis of rotation (16) away from and towards the bearing surface (15); and the guiding element (33) has a first guiding surface (35) for pivoting the clamping element (21) from an opened position into a closed position, in which the clamping surface (26) is situated at a distance (d) above the bearing surface (15) not clamping the tape (4).

14. A device according to claim 13, wherein the first guiding surface (35) has at least one inlet area (50) for the clamping elements (21).

15. A device according to claim 13, wherein the first guiding surface (35) has an outlet area (51).

16. A tensioning device for a packaging tape, which is slung around a stack of goods in a packaging station with a clamp for holding a free end of the tape, comprising:

a driving plate (13) which has an axis of rotation (16) and a bearing surface (15) for the tape (4);

a motor (14) which is in driving connection with said driving plate (13) and which is provided for driving said driving plate (13) around said axis of rotation (16) in a tensioning direction (11) of said tape (4);

clamping elements (21) each of which has a clamping surface (26) and which are associated with the driving plate (13);

a supporting area in which the tape (4) is supported by the bearing surface (15) and which extends over a surrounding angle (f) of the tape (4) around the bearing surface (15);

a closing area (52) which is smaller than the surrounding angle (f) of the tape (4) and which is arranged within said supporting area; and at least one guiding element (33) for the clamping elements (21), by means of which, in said closing area (52), the clamping elements (21) are brought into a position, in which the tape (4) is non-positively held between the clamping surfaces (26) of the clamping elements (21) and the bearing surface (15); and each clamping element (21) is guided pivotably in the direction of rotation (16) and slidable radially to it in an annular groove (20) of the driving plate

* * * * *